United States Patent [19]

Isenhart

[11] Patent Number: 4,869,466

[45] Date of Patent: Sep. 26, 1989

[54] ALL TERRAIN EDGE PROTECTOR

[76] Inventor: Kyle Isenhart, Rte. 2, Box RS1, Little Hocking, Ohio 45742

[21] Appl. No.: 939,082

[22] Filed: Dec. 8, 1986

[51] Int. Cl.[4] ..... B66D 1/36

[52] U.S. Cl. ..... 254/394; 474/210

[58] Field of Search ..... 254/389, 390, 394; 242/157 R; 474/206, 210, 219, 222, 226, 231, 223

[56] References Cited

U.S. PATENT DOCUMENTS

| | | | |
|---|---|---|---|
| 711,786 | 10/1902 | Poulson | 254/390 |
| 1,945,357 | 1/1934 | Pierce | 474/231 |
| 2,181,072 | 11/1939 | Sayers | 254/391 |
| 2,277,915 | 3/1942 | Klaucke | 474/210 |
| 3,110,479 | 11/1963 | Eitel . | |
| 3,145,016 | 8/1964 | Leithiser, Jr. . | |
| 3,218,033 | 11/1965 | Miller . | |
| 3,394,920 | 7/1968 | Pomeroy . | |
| 3,719,348 | 3/1973 | Wells . | |
| 3,804,373 | 4/1974 | Ross . | |
| 4,151,903 | 5/1979 | Martino | 254/390 |
| 4,227,425 | 10/1980 | Bendall | 474/223 |
| 4,260,119 | 4/1981 | Price | 254/394 |
| 4,402,489 | 9/1983 | Murray | 242/157 R |
| 4,417,718 | 11/1983 | Niskin | 254/394 |
| 4,423,852 | 1/1984 | Conroy et al. | 254/389 |
| 4,610,647 | 9/1986 | Weeds | 474/206 |

*Primary Examiner*—Stuart S. Levy
*Assistant Examiner*—Katherine Matecki
*Attorney, Agent, or Firm*—Charles W. Fallow

[57] ABSTRACT

Disclosed herein is a device for protecting rope from abrasion as it is drawn over building parapets, rock edges and irregular terrain. The device comprises a series of chain-like links having large side plates to retain the rope upon rods interconnecting the side plates. The side plates have both radial and axial free play upon the rods, so that the chain can twist substantially to adapt to the terrain.

10 Claims, 3 Drawing Sheets

Fig. 1
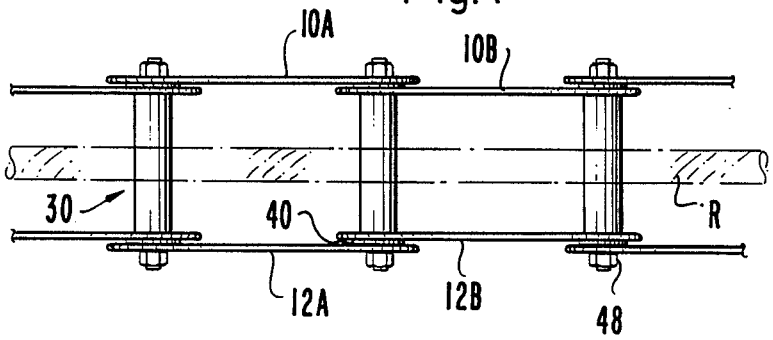
Fig. 2
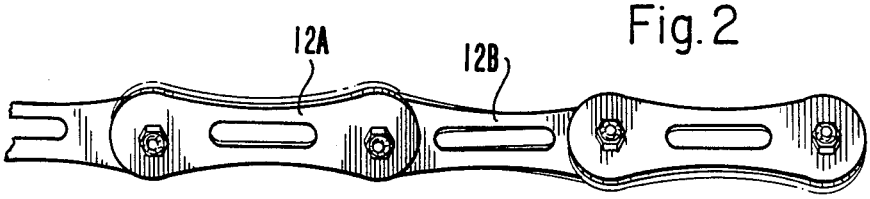
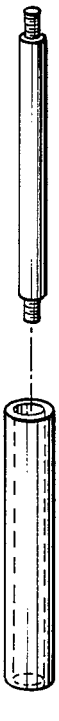
Fig.4
Fig. 5
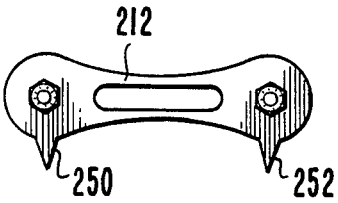
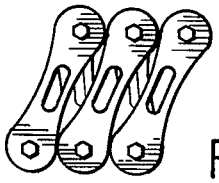
Fig. 8
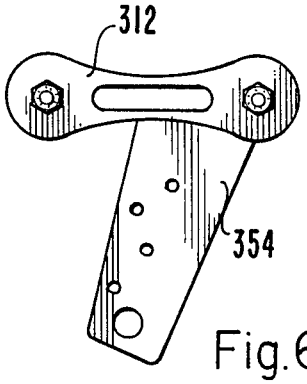
Fig. 6

ALL TERRAIN EDGE PROTECTOR

BACKGROUND OF THE INVENTION

This invention pertains to the art of mountain climbing and rescue equipment, particularly to devices for protecting climbing and hauling ropes from abrasion.

Pulling ropes over rocky terrain, the edges of buildings and other sharp corners naturally subjects the ropes to abrasion and eventual failure. Besides the safety implications, the not inconsiderable cost of quality climbing and rescue rope makes it desirable to develop some means to protect the rope from contact with such sharp and abrasive edges. In the past, simple rollers with concave surfaces have been placed near the edge to be avoided. However, these rollers are heavy, cumbersome and must be attached firmly to the surface in some way so as not to move about in use. No device of which I an aware has been presented that is both light enough to be conveniently carried by mounting climbers and sufficiently adaptable to irregular surfaces that it can follow them and thus need not be so accurately placed.

It is therefore an object of the invention to provide a rope protector for rocky terrain and the like that can be simply placed on the terrain with little or no securement and will protect the rope from contacting the surface.

A further object is to provide a rope protector that will flex and twist about its axis so as to follow irregular terrain contours.

Another object is to provide an apparatus that will resist side loads from the rope and will protect the rope from escaping laterally off the device. A related object is to create such a device with great lateral stability so that it will not tip under lateral loads.

Yet another object is to develop an edge protector that can be folded to a compact size for easy stowage.

These and other objects are achieved by the instant invention, which is embodied in a rope protector having a series of links, each link including a pair of side plates and a pair of rods interconnecting the side plates, each rod having a standoff thereon of sufficient length to allow free play between adjacent side plates, and means for securing the side plates upon the standoff.

Details of the invention and of various modifications thereof are described below.

BRIEF DESCRIPTION OF THE DRAWINGS

FIG. 1 is a plan view of a rope protector embodying the invention.

FIG. 2 is a side elevation thereof.

FIG. 4 shows a modified portion thereof in an exploded perspective view.

FIG. 5 is an elevational view, corresponding to a portion of FIG. 2, of another modification of the invention.

FIG. 6 is a view similar to FIG. 5, showing a further modification of the invention.

DESCRIPTION OF THE PREFERRED EMBODIMENT

Figure 3:
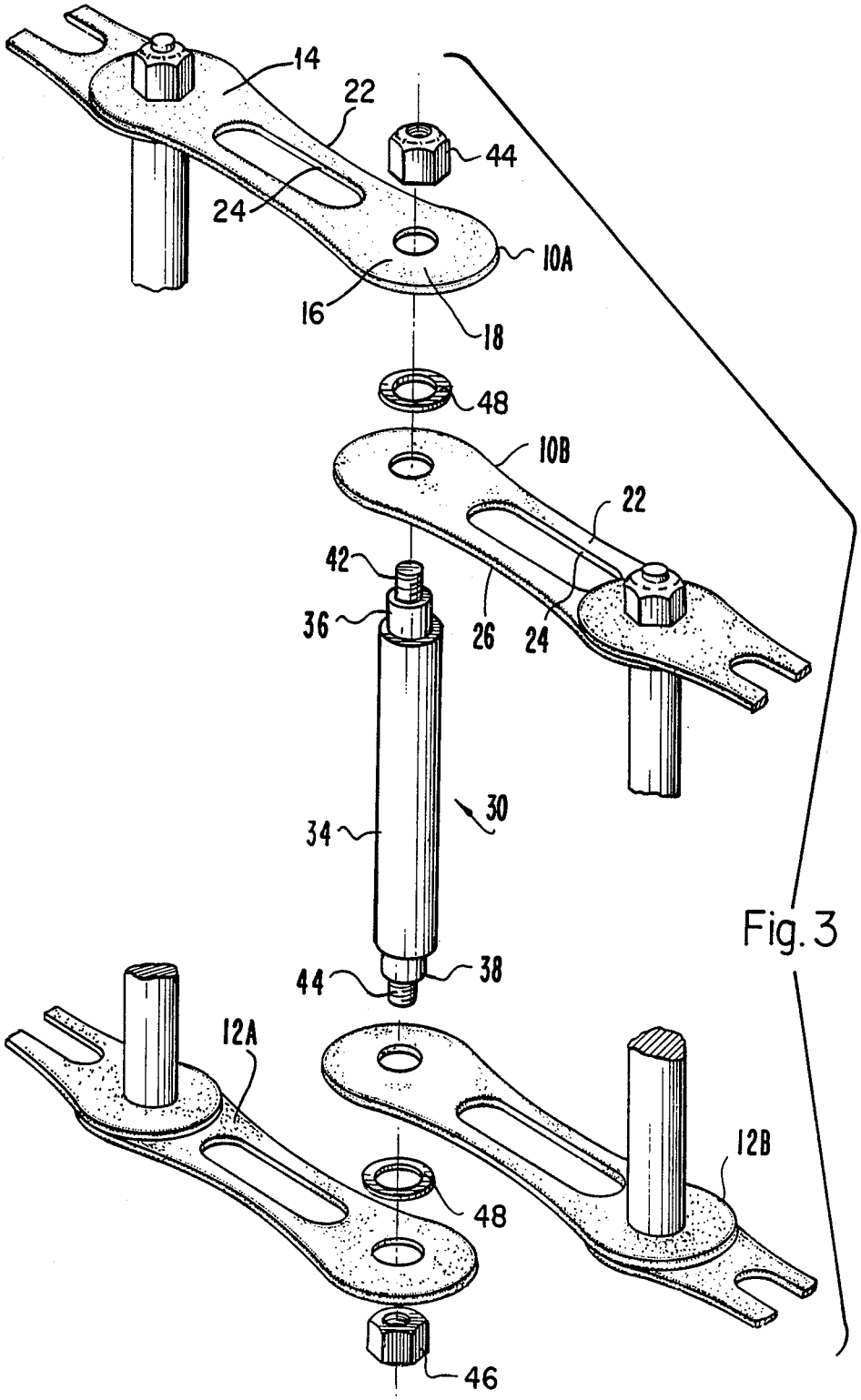
FIG. 3 is an exploded view thereof in perspective.

As shown in FIGS. 1–3, a rope protector embodying the invention includes a plurality of pivotally connected links A, B, etc., each comprising a pair of side plates 10, 12 (for link A the corresponding side plates are 10A and 12A; for link B, they are identified as 10B and 12B etc.).

Each side plate, for example 10B and FIG. 3, is substantially dogbone-shaped and includes opposed lobular ends 14 and 16, each having a hole 18 centrally drilled therethrough, this hole having a diameter D. The central portion 22 of each plate has an aperture in the form of an elongated through-slot 24 therein which may conveniently receive tiedown fasteners, as described further below.

Preferably, all edges of the side plates are rounded to prevent them from damaging any tie-down ropes or materials stowed next to the protector.

As illustrated in FIG. 3, the four side plates 10A, 10B, 12A and 12B of adjacent links A and B, are interconnected by a rod designated generally 30, having a main central portion 34, the ends of which are reduced in size to a diameter d so as to form standoffs 36 and 38 at either end thereof. The extreme ends of the rod are provided with threads 42 and 44, upon which locknuts 44 and 46 are installed to retain the side plates.

Between adjacent side plates, for example 10A and 10B, there is an annular spacer or washer 48. The washer prevents adjacent side plates from interfering with one another when the device is torsionally flexed, as shown in FIG. 2.

The diameter D of the hole 18 is substantially greater than the diameter d of the corresponding standoffs 36 and 38. This feature, in conjunction with the spacers 48, permits the unit to twist or flex substantially along its length, as shown in FIG. 2. For the device to flex freely, it is also important that the length of the standoffs 36 and 38 be greater than the sum of the thicknesses of the two side plates and the spacer 48 therebetween.

FIG. 4 shows a modification of the invention wherein the rod now designated 130, has a sleeve 134 with some radial clearance therebetween so that the sleeve 134 acts as a free roller. It would also be possible to provide this assembly with bushings or anti-friction bearings, if desired.

FIG. 5 shows a modified side plate which may advantageously be used in this invention at one or more links thereof. In this embodiment, the side plate 212 is provided with spikes 250 and 252 on one side thereof, the spikes being designed to dig into the terrain over which the device is placed.

FIG. 6 shows a third modification intended primarily for building parapets or other structures having perpendicular edges. In this case, at least one of the links 312 has fastened thereto a hook plate 354 on one side; the hook protrudes a substantial distance below the chain, and includes a surface 356 generally perpendicular to the length of the link for engaging a building parapet.

Figure 7:
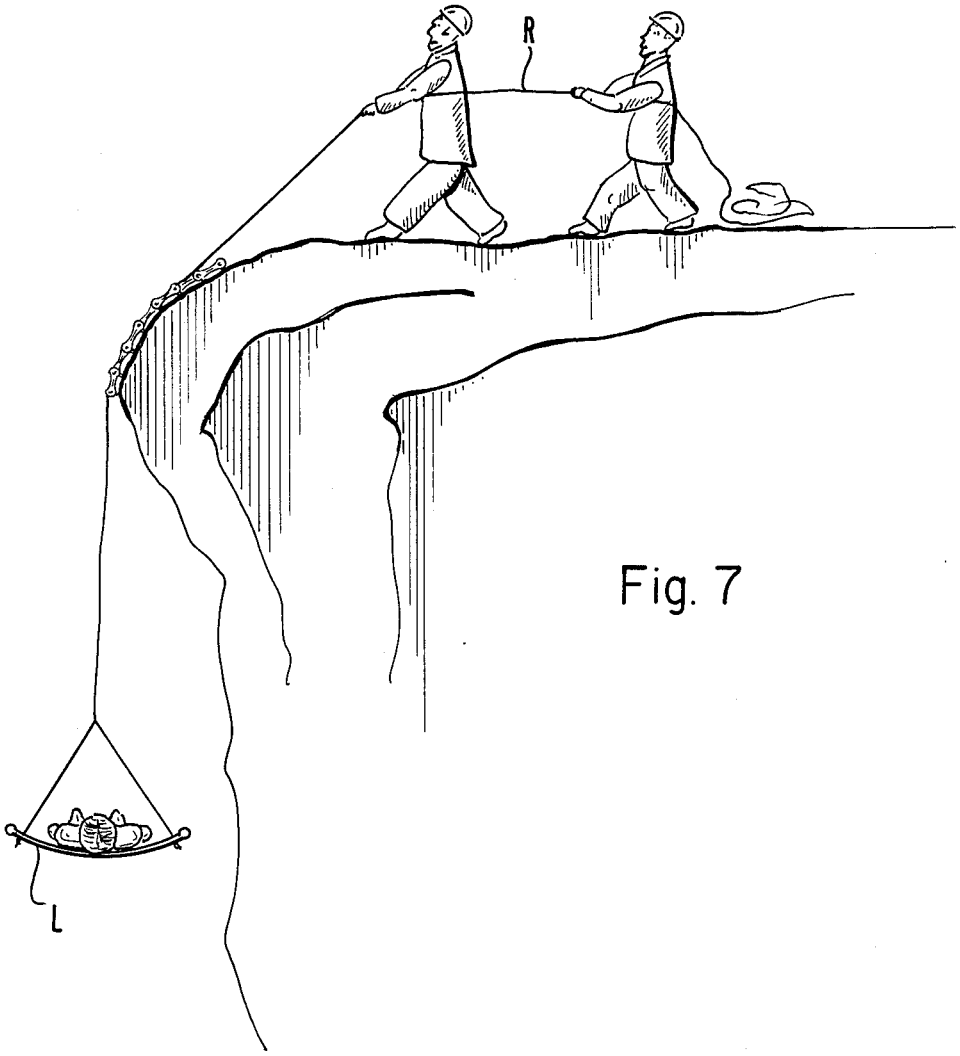
FIG. 7 is a side elevation of the invention in operation.

FIG. 7 shows the inventive device being used to lift a litter L in a rescue effort. As shown, the rope protector has been attached to the terrain at at least one point by means of a suitable spike, or other means of attachment, conveniently engaged within the slot 24 of at least one link. A rope R has been placed over the device, riding on the rods 30 as shown in FIG. 1. The rope is retained on the rods by the side plates 10 and 12, whose substantial height prevents the rope from sliding off laterally. Also, the great width of the chain helps to prevent it from tipping when substantial lateral loads are developed between the rope and the side plates.

An additional advantage of my rope protector is that it can conveniently be folded and stowed in a small space, as shown in FIG. 8.

Inasmuch as the invention is subject to various changes and modifications, it is intended that the foregoing shall be regarded as only illustrative of the invention whose full scope is set out in the following claims.

I claim:

1. A device for protecting a rope from sharp edges over which the rope is drawn, comprising a series of chain links, each link including:

a pair of side plates, each of said side plates having a pair of through holes, a pair of rods interconnecting said side plates, each of said rods including a central portion having a diameter greater than that of said holes and also having a pair of end portions of substantially lesser diameter than said holes, the end portions of the rods passing through the respective holes with substantial radial free play therebetween, for permitting the device to bend and twist about its axis, whereby the device is stable on irregular terrain contours and will protect the rope from escaping laterally off the device, and means for retaining the side plates upon said end portions.

2. The invention of claim 1 further comprising a screw thread upon each of said end portions and wherein said retaining means include a nut threaded onto said threads to retain the side plates.

3. The invention of claim 1 wherein each of said rod end portions includes a substantially cylindrical standoff of substantially lesser diameter than said holes and a threaded portion of lesser diameter than said standoff outboard of the same.

4. The invention of claim 3 wherein said retaining means include a nut threaded onto said threads to retain the side plates.

5. The invention of claim 4, further comprising an annular spacer between adjacent side plates at either end of said rod.

6. The invention of claim 5, wherein said standoff has an axial length greater than the sum of the thicknesses of both of the side plates mounted upon it plus the thickness of said annular spacer, so as to provide axial free play.

7. The invention of claim 1, wherein each of said side plates has a central aperture through which tie-down devices may be placed for securing the device to the terrain.

8. The invention of claim 1, wherein each of said side plates includes at least one peripherally projecting spike to prevent the device from sliding over the terrain.

9. The invention of claim 1, wherein at least one of said links has a hook extending laterally therefrom, said hook having a parapet engaging surface substantially perpendicular to the length of said link.

10. The invention of claim 1, wherein each of said rods further comprises a rotatable outer sleeve.

* * * * *